US006050792A

United States Patent [19]

Shaffer

[11] Patent Number: 6,050,792

[45] Date of Patent: Apr. 18, 2000

[54] MULTI-STAGE SCROLL COMPRESSOR

[75] Inventor: Robert W. Shaffer, County of Butler, Ohio

[73] Assignee: Air-Squared, Inc., Hamilton, Ohio

[21] Appl. No.: 09/228,485

[22] Filed: Jan. 11, 1999

[51] Int. Cl.[7] ..... F01C 1/30

[52] U.S. Cl. ..... 418/5; 418/6; 418/55.2; 418/15

[58] Field of Search ..... 418/6, 55.2, 15

[56] References Cited

U.S. PATENT DOCUMENTS

| | | | |
|---|---|---|---|
| 4,157,234 | 6/1979 | Weaver et al. | 418/6 |
| 4,457,674 | 7/1984 | Kawano et al. | 418/6 |
| 4,477,238 | 10/1984 | Terauchi | 418/5 |
| 5,836,752 | 11/1998 | Calhoun et al. | 418/55.2 |
| 5,857,844 | 12/1999 | Lifson et al. | 418/1 |
| 5,873,711 | 2/1999 | Lifson | 418/55.2 |
| 5,951,268 | 9/1999 | Pottier et al. | 418/5 |

*Primary Examiner*—Thomas Denion
*Assistant Examiner*—Theresa Trien
*Attorney, Agent, or Firm*—Paul M. Denk

[57] ABSTRACT

A scroll is provided which can be operated as either a vacuum pump, a low pressure compressor or a high pressure compressor. The scroll includes a housing, a fixed scroll plate having a continuous fixed involute wrap and an orbiting scroll plate having a continuous orbiting involute wrap. The wraps are of constant width and pitch. The fixed and orbiting scroll plates are mounted in the housing with their involute wraps extending toward each other to define a series of chambers. The fixed involute wrap and orbiting involute wrap each have at least a first section of one height and a second section of a second different height. Additionally, the scroll includes a first port proximate a peripheral edge of the housing, a second port proximate the center of the housing, and at least one mid-port; the mid-port being located proximate the change in height between the first and second sections of the involute wraps.

4 Claims, 3 Drawing Sheets

MULTI-STAGE SCROLL COMPRESSOR

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to scroll compressors, and in particular to a multi-stage scroll compressor having more than one discharge pressure, and which can operate as a compressor or as a vacuum pump.

Many pneumatic applications require combinations of discharge pressures. Such combinations include, for example, pressure and vacuum, pressures at two or more discharge pressures, and higher pressures requiring two or more stages. Applications where such combinations are currently required include pneumatic controls for heart balloons which require pressure and vacuum, and refrigerant recovery systems which require high pressures for the recovery of refrigerant and a vacuum for evacuating the refrigerant system before charging of the system. In systems which require high pressures, such as refrigerant recovery systems, it is generally beneficial to have a two stage compressor and a vacuum pump.

It is presently common to separate the compressor and vacuum functions. For example, a separate compressor and vacuum pump are used in refrigerant recovery. One is used to recover the refrigerant and another unit is used to evacuate the system. The pneumatic controls for heart balloons include a compressor mounted to one end of the motor and a vacuum pump mounted to the opposite end. The compressor will then fill the balloon and the compressor will deflate the balloon. In multi-stage applications, more than one pumping unit is typically employed.

The use of two units adds cost and complexity to devices, such as those noted above. It would be beneficial if the two functions could be incorporated into a single device.

BRIEF SUMMARY OF THE INVENTION

A scroll of the present invention can be operated as either a vacuum pump, a low pressure compressor or a high pressure compressor. The scroll includes a housing, a fixed scroll plate having a continuous fixed involute wrap and an orbiting scroll plate having a continuous orbiting involute wrap. The wraps are of constant width and pitch. The fixed and orbiting scroll plates are mounted in the housing with their involute wraps extending toward each other to define a series of chambers. The fixed involute wrap and orbiting involute wrap each have at least a first section of one height and a second section of a second different height. Additionally, the scroll includes a first port proximate a peripheral edge of the housing, a second port proximate the center of the housing, and at least one mid-port; the mid-port being located proximate the change in height between the first and second sections of the involute wraps.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
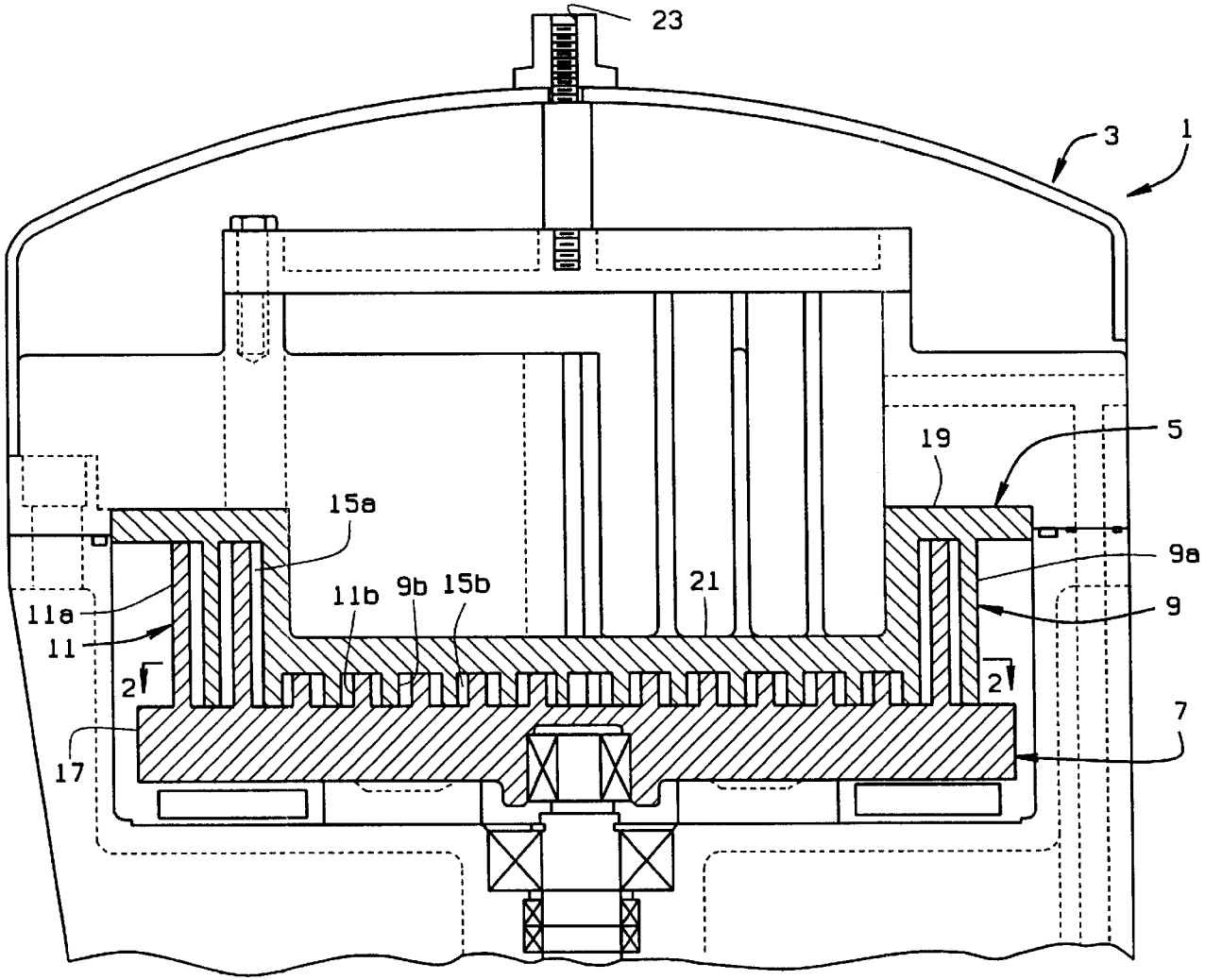
FIG. 1 is a sectional view of a multi-stage scroll-compressor of the present invention.
Figure 2:
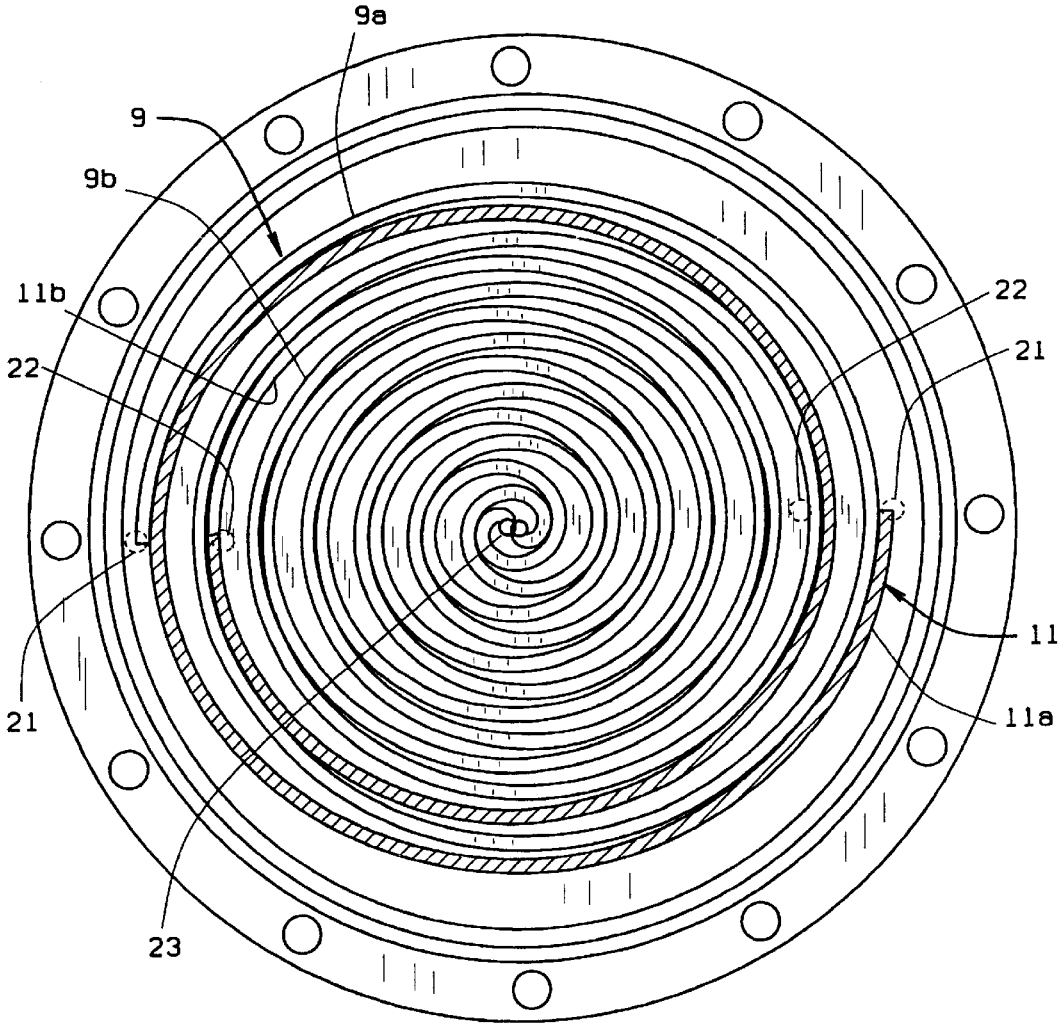
FIG. 2 is a sectional view of the scroll-compressor taken along line 2—2 of FIG. 1.

The scroll-compressor 1 includes a housing 3 which encloses a fixed involute plate 5 and an orbiting involute plate 7. Each plate includes an involute wrap 9 and 11, respectively. As seen in FIG. 2, the wraps 9 and 11 are continuous spirals. However, the wraps are dividable into outer sections 9*a,* 11*a* and 9*b,* 11*b*. The outer wrap sections 9*a* and 11*a* have a different height than the inner wrap sections 9*b* and 11*b*. As shown in FIG. 1, the wrap sections 9*a* and 11*a* are taller than the wrap sections 9*b* and 11*b*. The wrap sections 9*a,* 9*b* and 11*a,* 11*b* are continuous. That is, there is no break between wrap section 9*a* and 9*b* or between wrap section 11*a* and 11*b*. Additionally, the wall thickness and pitch is maintained at a constant desired thickness and pitch throughout the entire length of the wraps 9 and 11. The scroll-compressor includes a pair of ports 22 at the diameter where the change in height occurs. Thus, the only difference is that the outer wraps 9*a,* 11*a* define chambers 15*a* which are taller than the chambers 15*b* defined by the inner wrap sections 9*b,* 11*b*.

As seen in FIG. 1, the orbiting involute plate 7 includes a generally flat plate 17 from which the wrap 9 extends. The fixed plate 5, on the other hand, includes an outer annular section 19 and an inner section 21, from which the wrap sections 9*a* and 9*b* depend from, respectively. The two sections 19 and 21 of the plate 5 are spaced axially from each other. In FIG. 1, to accommodate the shorter wrap sections 9*b,* the inner section 21 of plate 5 is axially closer to the orbiting plate than is the outer section 19. Thus, as noted above, the outer chambers 15*a* are taller than the inner chamber 15*b*. Therefore, the percentage change in pressure between the entrance and exit to the outer wraps is less than the percentage change in the pressure between the entrance and exit to the inner wraps.

The scroll compressor 1 includes three sets of ports. It has inlet ports 21 at the entrance of the outer wrap sections 9*a* and 11*a,* mid-ports 22 at the change between the wrap sections (i.e., where the wrap height changes), and outlet ports 23 at the center of the compressor. The mid-ports 22 are the exit from the outer section and the entrance to the inner section of the involute wraps.

Figure 3:
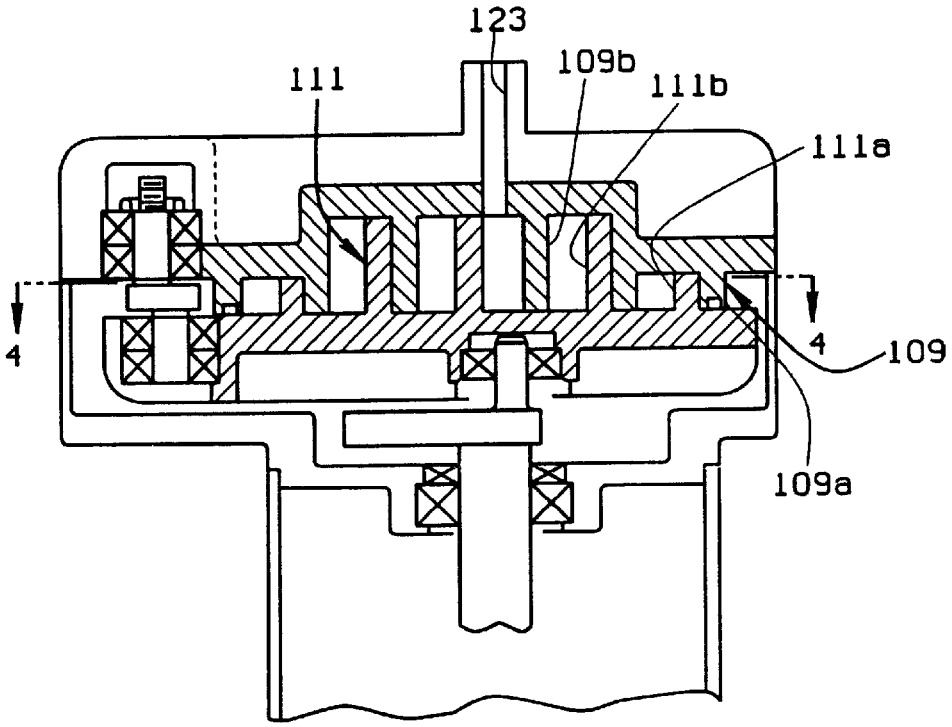
FIG. 3 is a sectional view of a second embodiment of the scroll-compressor.
Figure 4:
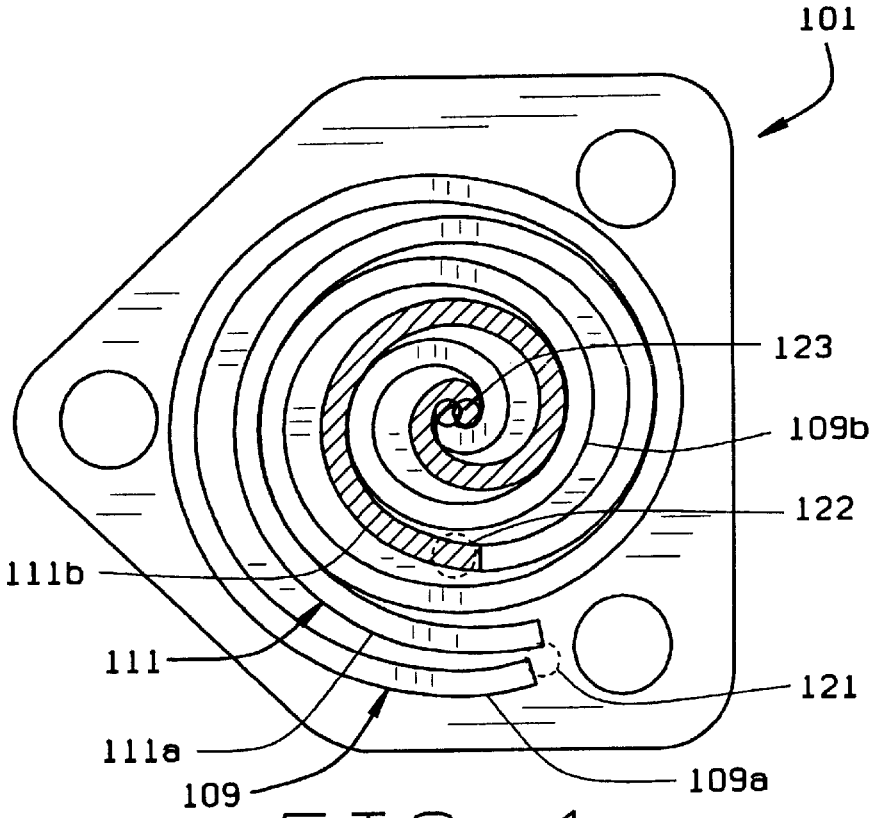
FIG. 4 is a sectional view of the scroll-compressor taken along line 4—4 of FIG. 3.

The scroll compressor 101 shown in FIGS. 3 and 4 is just the opposite of the scroll compressor 1 of FIGS. 1 and 2. In the scroll compressor 101, the outer sections 109*a,* 111*a* of wraps 109 and 111 are shorter than the inner sections 109*b* and 111*b*. It also has three ports, an inlet port 121, a mid-port 122, and a central outlet port 123. The inlet port 121 is the inlet to the outer section of the compressor; the mid-port 122 is both the outlet to the outer section and the inlet to the inner section, and the central port 123 is the outlet from the inner section.

The pressure ration of the inner and outer sections of the compressors 1 and 101 are independent of each other, and are determined by the number of spiral wraps in each section. The only requirement is that the discharge (or outlet) pressure of the outer section be equal to the inlet pressure of the second (or inner section) or stage.

Thus, if the scroll-compressor were to be operated as a combination pressure and vacuum pump, the inlet 121 of compressor 101 (FIGS. 3 and 4) would be connected to a vacuum source; the mid-port would be open to the atmosphere; and the outlet or discharge port 123 would be connected to a pressure source.

If the unit were to be used with refrigerant recovery where displacement is relatively low, but the pressure ratio can be high, the outer stage would be bypassed and only the inner stage would be used for recovery. Thus, the mid-ports would be used as the inlet to the compressor. For system evacuation, the outer stage, which has a large displacement would be used for achieving a rough vacuum quickly and the inner stage would be by-passed. To achieve higher vacuums, the outer and inner stages would be connected in series by closing the mid-port. This would result in a two stage vacuum pump.

As can be appreciated from a review of the foregoing specification, the scroll-compressor of the present invention produces two different compression processes on the same scroll. This is facilitated by the mid-ports 22 and 122. The provision of the mid-ports 22 and 122, in association with the involute wraps 9, 11, 109 and 111, allows for a single scroll to be used as a vacuum pump, a low pressure compressor, or a high pressure compressor, depending on how the outer port, mid-port, and inner port are utilized.

In view of the above, it will be seen that the advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. Although only two stages are shown, more stages could be employed. Thus, the scroll compressor could have three, four or more stages. There would be a mid-port for each stage, to allow for various stages to be by-passed, connected in series, or open to the atmosphere, as may be desired for a particular function.

I claim:

1. A scroll which can be operated as either a vacuum pump, a low pressure compressor or a high pressure compressor; the scroll including a housing, a fixed scroll plate having a continuous fixed involute wrap and an orbiting scroll plate having a continuous orbiting involute wrap; the fixed and orbiting scroll plate being mounted in the housing with the involute wraps extending toward each other to define a series of chambers; the fixed involute wrap and orbiting involute wrap each having at least a first section of one height and a second section of a second different height; the scroll further including a first port proximate a peripheral edge of the housing, a second port proximate the center of the housing, and at least one mid-port; the mid-port being located proximate the change in height between the first and second sections of the involute wraps.

2. The scroll of claim 1 wherein the wraps are of constant width and pitch.

3. The scroll of claim 1 wherein the first section of the wraps is taller than the second section of the wraps; the first wrap sections surrounding the second wrap sections.

4. The scroll of claim 1 wherein the first section of the wraps is shorter than the second section of the wraps; the first wrap sections surrounding the second wrap sections.

* * * * *